US006323746B1

(12) United States Patent
Prager et al.

(10) Patent No.: US 6,323,746 B1
(45) Date of Patent: Nov. 27, 2001

(54) DIELECTRIC MOUNTING SYSTEM

(75) Inventors: Lee A. Prager, Berlin, MA (US); Timothy M. Ebling, Naples; Thomas W. Godan, Old Orchard Beach, both of ME (US)

(73) Assignee: Control Devices, Inc., Standish, ME (US)

( * ) Notice: Subject to any disclaimer, the term of this patent is extended or adjusted under 35 U.S.C. 154(b) by 0 days.

(21) Appl. No.: 09/442,257

(22) Filed: Nov. 17, 1999

Related U.S. Application Data

(63) Continuation-in-part of application No. 09/078,245, filed on May 13, 1998, now abandoned.
(60) Provisional application No. 60/056,951, filed on Aug. 25, 1997.

(51) Int. Cl.[7] ..... H01P 7/10
(52) U.S. Cl. ..... 333/219.1; 333/235
(58) Field of Search ..... 333/202, 208, 333/209, 212, 219, 219.1, 227, 229, 231, 235

(56) References Cited

U.S. PATENT DOCUMENTS

| | | | | |
|---|---|---|---|---|
| 4,121,181 | | 10/1978 | Nishikawa et al. | 333/202 |
| 4,477,788 | | 10/1984 | Collinet et al. | 333/235 |
| 4,500,859 | | 2/1985 | Ren et al. | 333/208 |
| 4,630,012 | | 12/1986 | Fuller et al. | 333/235 |
| 4,728,913 | | 3/1988 | Ishikawa et al. | 333/235 |
| 4,757,289 | * | 7/1988 | Kosugi et al. | 333/235 X |
| 4,939,489 | | 7/1990 | Gueble et al. | 333/202 |
| 4,963,841 | | 10/1990 | Sparagna | 333/202 |
| 5,097,238 | | 3/1992 | Sato et al. | 333/219.1 |
| 5,105,158 | | 4/1992 | Fiedzuiuszko et al. | 324/693 |
| 5,111,170 | | 5/1992 | Ohya | 333/219.1 |
| 5,136,270 | | 8/1992 | Hatanaka et al. | 333/219.1 |
| 5,200,721 | | 4/1993 | Mansour | 333/202 |
| 5,233,319 | | 8/1993 | Mizan et al. | 333/219.1 |
| 5,311,160 | | 5/1994 | Higuchi et al. | 333/219.1 |
| 5,323,129 | | 6/1994 | Harris | 333/219.1 |
| 5,329,687 | | 7/1994 | Scott et al. | 29/527.2 |
| 5,347,246 | | 9/1994 | Bellows et al. | 333/219.1 |
| 5,373,270 | * | 12/1994 | Blair et al. | 333/219.1 X |
| 5,515,016 | | 5/1996 | Holme et al. | 333/202 |
| 5,612,655 | | 3/1997 | Stronks et al. | 333/202 |
| 5,691,677 | | 11/1997 | De Maron et al. | 333/219.1 |
| 5,712,606 | | 1/1998 | Särkkä | 333/219.1 |
| 5,736,912 | | 4/1998 | Mikami et al. | 333/235 |
| 5,987,341 | * | 11/1999 | Hodge et al. | 333/219 X |
| 6,069,105 | * | 5/2000 | Yamamoto et al. | 333/219.1 X |

FOREIGN PATENT DOCUMENTS

| | | | | |
|---|---|---|---|---|
| 0 790 661 A2 | | 8/1997 | (EP) . | |
| 8-222918 | * | 8/1996 | (JP) | 333/219.1 |
| 9-186511 | * | 7/1997 | (JP) | 333/219.1 |
| 9-186512 | * | 7/1997 | (JP) | 333/219.1 |
| 5-325639 | * | 12/1993 | (JP) | 501/135 |
| WO 97/02617 | | 1/1997 | (WO) . | |

* cited by examiner

*Primary Examiner*—Robert Pascal
*Assistant Examiner*—Barbara Summons
(74) *Attorney, Agent, or Firm*—Woodard, Emhardt, Naughton, Moriarty & McNett

(57) ABSTRACT

A dielectric resonator system having a dielectric element and a purified alumina attachment assembly both housed within a metallic resonant casing. Attachment assembly is at least 99.5% pure alumina. Attachment assembly couples dielectric element to the casing. Dielectric element is an internally threaded ring or disk. Attachment assembly includes an externally threaded alumina support member coupled to the internally threaded dielectric element.

27 Claims, 9 Drawing Sheets

DIELECTRIC MOUNTING SYSTEM

CROSS-REFERENCE TO RELATED APPLICATION

This application is a continuation-in-part of U.S. patent application Ser. No. 09/078,245, filed May 13, 1998 and now abandoned, and claims the benefit of U.S. Provisional Application No. 60/056,951, filed Aug. 25, 1997.

TECHNICAL FIELD OF THE INVENTION

The present invention relates generally to dielectric devices, and more specifically to the mounting of dielectric resonators in resonant cavities.

BACKGROUND OF THE INVENTION

It is well known among electrical engineers that energy losses in dielectric resonator systems occur at contact boundaries, such as those between the dielectric and its support or between the dielectric and the cavity boundary. Energy losses both degrade the efficiency of the resonator by subtracting energy from the system and increase its temperature through resistance heating.

Dielectric resonators are used to confine electromagnetic fields mostly within their boundaries. Dielectric resonators are commonly used in electronic communication devices, such as cellular telephone systems. There is an increasing demand for smaller versions of such systems and other electronic devices. Accordingly, there is a need for smaller dielectric resonators that are capable of the same dielectric performance. Dielectric resonators may be miniaturized by using dielectric elements with higher dielectric constants. The trade-off for the decrease in size of the resonator is that the same amount of power is being drawn through a smaller device. Unless there is an increase in the efficiency of heat removal from the resonator, miniaturization results in the same heat being generated in a smaller volume and a corresponding rise in operating temperatures. It is therefore useful to develop devices exhibiting either less power loss, better thermal dissipation capabilities, or both.

As the temperature of a dielectric element increases, its dielectric constant shifts. Large increases in operating temperatures will therefore result in a shift of the resonant frequency of a dielectric resonator. Temperature differentials and thermal cycling can also contribute to mechanical creep, structural instabilities, component misalignment, debonding, and other undesirable changes in the resonator. It is therefore important to minimize excess heat generated in the resonator, efficiently drain the generated waste heat, and choose components with compatible physical characteristics for use with dielectric element.

In prior dielectric resonator systems, the resonating dielectric element has been secured within its resonant cavity by a variety of mounting media. These include a mounting stem formed as part of the resonating body, adhesives to bond the resonator to a ceramic support and the ceramic support to the casing floor, adhesives to bond the dielectric resonator directly to the casing floor, and insulators to sandwich the dielectric resonator securely within the cavity. Mounting media used in the prior art include media formed from dielectrics, quartz, and plastics. Each of these mounting materials has its own inherent disadvantages.

Adhesives introduce extrinsic energy loss into the system and thereby lower the Q-factor of the resonator. Furthermore, adhesives degrade with time, temperature cycling, and thermal and mechanical shock. Moreover, adhesives introduce assembly inefficiencies because they are cumbersome, messy, and difficult to use with reproducible accuracy. Finally, adhesives tend to be poor thermal conductors and hinder the dissipation of heat from the system.

Some dielectric resonator systems have used quartz to support dielectric element within the resonant cavity. Dielectric element is usually attached to the quartz with an adhesive having all of the disadvantages listed above. Moreover, the coefficients of thermal expansion of the dielectric and the quartz are generally substantially disparate, requiring a flexible adhesive bond to prevent delamination of the adhesive or degradation of the bond.

A mounting stem formed as part of the dielectric resonator does not suffer from the above-mentioned problems associated with adhesives, but can instead distort the electromagnetic field within the cavity. Additional energy loss can be introduced as induced current in the casing. Further, many good dielectric resonators tend to be poor thermal conductors, retarding heat dissipation from the system. Finally, the formation of a one-piece resonator with a stem increases the complexity of the manufacturing process.

Plastic support structures are typically not suitable for use in high temperature applications, as plastic tends to lose structural integrity with increasing temperature. Additionally, plastics typically are poor thermal conductors. Moreover, high-temperature plastics are generally lower-Q materials and contribute to frequency drift with temperature. High-Q plastics, such as high-density polyethylene and high-density polystyrene, quickly lose structural integrity above 100° C.

Finally, the use of sandwiching introduces variables such as stacking tolerances and positioning fluctuations within the cavity with respect to dielectric element.

Hence, there is a need for an improved method of securing the dielectric resonator within the resonant cavity. The securing method must be capable of producing a dielectric resonator system with fewer energy losses and better thermal dissipation, and improved mechanical stability at elevated temperatures. A means for satisfying this need has so far eluded those skilled in the art.

SUMMARY OF THE INVENTION

One form of the present invention contemplates an externally threaded ceramic support member removably coupled to an internally threaded dielectric ring. The ceramic support member is secured to an internal floor or wall of a cavity, and is at least about 99.5% pure alumina.

One object of the present invention is to reduce energy loss at the dielectric mount interface by providing an improved means for mounting the dielectric.

Related objects and advantages of the present invention will be apparent from the following description.

DETAILED DESCRIPTION OF THE PREFERRED EMBODIMENT

Figure 1A:
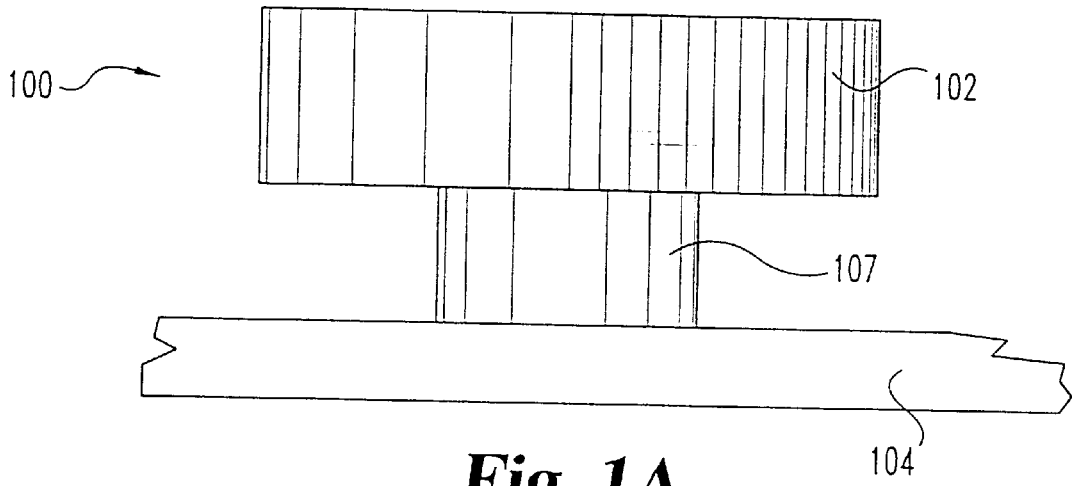
FIG. 1A is a side view of a dielectric element supported by a first embodiment attachment assembly of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

A dielectric is operationally defined to be any material that is not a good electrical conductor (electrical conductor defined as a material having an electrical resistivity less than about $10^4$ ohm-cm.) Dielectric resonators generally comprise a dielectric element with a relatively high dielectric constant (greater than about 10) enclosed within a cavity. The casing defining the cavity is usually metallic to minimize interference from external electromagnetic radiation.

A dielectric element used in a dielectric resonator is usually formed of a ceramic material with a high dielectric constant and a high Q-factor and usually has a symmetrical geometry, such as cylindrical. The dielectric may be doped to fine-tune its dielectric and electronic properties to suit a given application, as is known in the art.

Dielectric resonators operate by the reflection of electromagnetic waves at the interface between two dielectrics with different dielectric constants. A resonator operates to absorb and reradiate energy at its resonant frequency. The resonant frequency is dependent upon the dielectric properties of the resonator, specifically the dielectric element, the size and shape of the resonant cavity, and the placement of the delectric element within the resonant cavity. The dielectric resonator may be tuned by varying the placement of the resonator within the resonant cavity. Dielectric resonators are commonly used in filters and oscillators.

A dielectric resonator with a high dielectric constant can confine a large electromagnetic field mostly within its boundaries. Consequently, the availability of dielectrics with increasingly high dielectric constants has lead to increasingly smaller resonators. While attractive for use in smaller and more convenient devices, miniaturization has resulted in the same power being drawn through smaller devices. Without a corresponding increase in efficiency, the miniaturization of the dielectric resonator can lead to the same heat being generated in a smaller volume. This can give rise to higher operating temperatures as well as smaller areas through which to dissipate the generated waste heat. It is increasingly critical to develop devices that either exhibit less power loss, have better thermal dissipation capabilities, or both.

Furthermore, as the temperature of a dielectric increases, its dielectric constant shifts. While some materials, such as ceramic perovskites, are more thermally stable with respect to their dielectric properties than most, large increases in operating temperatures will nonetheless cause even their dielectric properties, and therefore the resonant frequencies of dielectric resonators formed from them, to shift. Moreover, differential thermal expansion and thermal cycling can contribute to problems such as mechanical creep, structural instabilities, component misalignment, and debonding. It is therefore desirable to choose components with similar thermal expansion characteristics as well as to allow for fine-tuning of the dielectric resonator.

Traditionally, ceramic materials have generally been attractive for use in structural applications requiring high compressive strengths, but not in applications requiring high tensile or shear strengths. Moreover, ceramic materials are notoriously brittle. As a result, the use of ceramic materials as threadedly interlocking fasteners has been minimal. Ceramic fasteners, especially those utilizing a matably threaded ceramic-to-ceramic interface (i.e., a nut on a screw or bolt) have long been considered impractical to produce because of their inherent brittleness and frangibility.

The present invention relates generally to an improved system for mounting a dielectric body or element within a resonant cavity. More particularly, the present invention has one form wherein an internally threaded ceramic dielectric resonator element is matably coupled to an externally threaded ceramic support member that is in turn secured to a floor or wall of the resonant cavity. Where the operation of the resonator will produce significant amounts of waste heat, the support member should be formed of a material with a relatively high thermal conductivity and/or high temperature stability, such as alumina.

In addition to having high thermal conductivity, the support member should also have a coefficient of thermal expansion closely matched to that of the attached dielectric element. During normal operation, dielectric element can generate a significant amount of heat. If the support member and the threadedly attached dielectric element have substantially different coefficients of thermal expansion, the heat generated by dielectric element during operation will cause dielectric element and its support to expand at different rates, putting a mechanical strain on the threaded connection. Over time, repeated thermal cycling can degrade dielectric element and/or the support member. Brittle materials, such as ceramics, are especially sensitive to this type of mechanical degradation.

The support member should also have a relatively low dielectric loss tangent, Q, that is also relatively stable over the operating temperature range. Since the support structure is positioned within the resonant cavity, dielectric losses and the accompanying heat generation from the support structure are proportional to its dielectric loss tangent. Therefore, it is desirable that the support structure have a low dielectric loss tangent. Moreover, the dielectric properties of the support structure should be stable over the operating temperature range of the resonator to prevent unpredictable and/or catastrophic changes in the dielectric properties of the system.

Another related set of characteristics describing the support structure that helps minimize the dielectric loss of the resonator is the support structure's size and strength. The stronger the material, the smaller the support structure has to be. And the smaller the support structure, the lower the effective dielectric loss and associated heat generation from the support structure's presence in the resonant cavity. Therefore, small support members formed of mechanically strong materials are generally preferable.

Figure 1B:
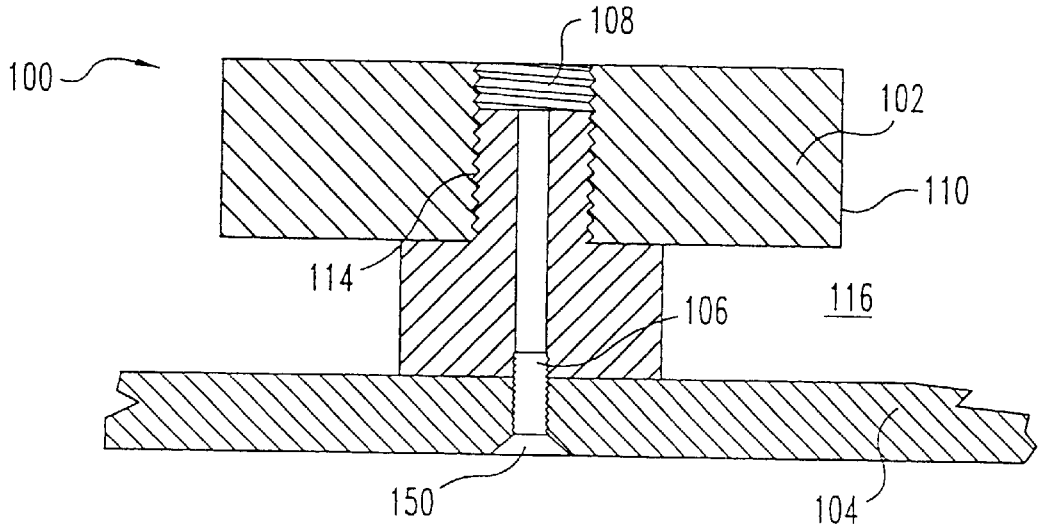
FIG. 1B is a cross-sectional side view of a dielectric element having a partially threaded internal recess screwed to the first embodiment attachment assembly of FIG. 1A.
Figure 1C:
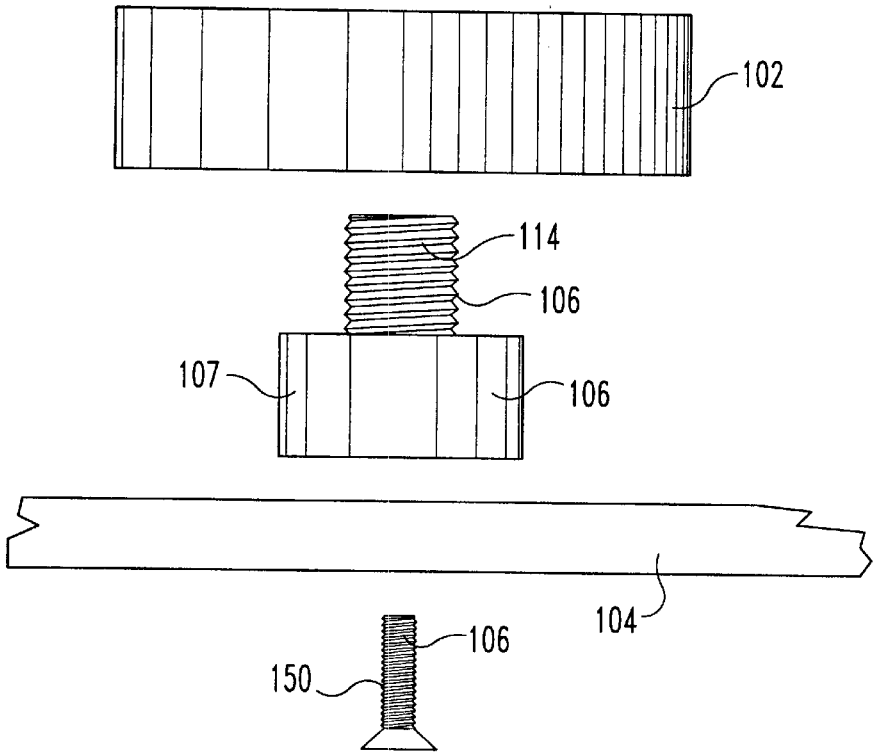
FIG. 1C is an exploded cross-sectional side view of dielectric element of FIG. 1B.

FIGS. 1A–1C illustrate a preferred embodiment of the present invention, a dielectric resonator mounting system 100 having a dielectric element 102 fastened to the interior of a housing 104 by an attachment assembly 106. Dielectric element 102 preferably comprises a ceramic dielectric composition such as an alkaline-earth titanate, tantalate, aluminate, niobate or the like. The composition of dielectric element 102 may further include dopants such as small amounts of rare earth elements, alkaline-earth elements, or the like, but may be any convenient dielectric composition having desirable dielectric and mechanical properties.

Dielectric element 102 preferably has a coefficient of thermal expansion of about $5–10\times10^{-6}$, and more preferably has a coefficient of thermal expansion substantially equal to or greater than that of attachment assembly 106. Dielectric element 102 preferably includes a threaded recess 108 and is formed with a symmetrical shape. Dielectric element 102 is more preferably an internally threaded ring having an outer surface (diameter) 110 and an at least partially threaded inner surface (diameter) defining a recess 108. Dielectric element 102 may be formed by any convenient process, such as isostatic or uniaxial pressing and green machining (such as tapping, thread milling, or lathing).

Attachment assembly 106 is preferably formed of alumina. Attachment assembly 106 is also preferably at least about 99.5% pure, and is more preferably at least about 99.9% pure. Attachment assembly 106 preferably has a dielectric loss tangent of less than about 0.0001 and preferably has a thermal conductivity of at least about 25 W/m/K at 25° C. Attachment assembly 106 preferably has a coefficient of thermal expansion of about $5\times10^{-6}$/° C., and more preferably has a coefficient of thermal expansion substantially equal to that of dielectric element 102. It is desirable that the coefficients of thermal expansion of dielectric element 102 and of attachment assembly 106 be matched as closely as possible, since they are to be threadedly attached. Attachment assembly 106 may likewise be formed of any convenient process, such as high or low pressure injection molding, uniaxial pressing and green machining, or isostatic pressing and green machining. Additional grinding may be required after sintering to fully form the threading. Ceramic attachment assembly 106 is preferably at least about 99.5% pure and is preferably formulated to be a good electrical insulator. Electrical insulators are defined as any material having an electrical resistivity in excess of about $10^{13}$ ohm cm. In other embodiments, ceramic attachment assembly 106 may include electrically non-insulating components, such as semiconducting ceramics or ceramic composites, or electrically conducting ceramic composites.

Attachment assembly 106 of the preferred embodiment preferably includes a cylindrical member 107 that is at least partially externally threaded, having external threads 114 adapted to threadedly engage the threaded portion of recess 108 of dielectric element 102. Attachment assembly 106 connects dielectric element 102 to the interior of housing 104. Attachment assembly preferably includes fastener 150 adapted to threadedly attach cylindrical member 107 to housing 104. Housing 104 is preferentially formed of metal and defines a resonant cavity 116. The heat generated by operating dielectric element 102 is conducted away by attachment assembly 106 to housing 104 and then to a heat sink (not shown). By eliminating interfaces (such as from connectors or adhesives between dielectric element 102 and attachment assembly 106 and/or between attachment assembly 106 and housing 104) from system 100, heat retention is reduced both because heat is no longer generated at the eliminated interfaces by dielectric attenuation and because thermal conduction is not slowed at the eliminated interfaces.

Figure 1D:
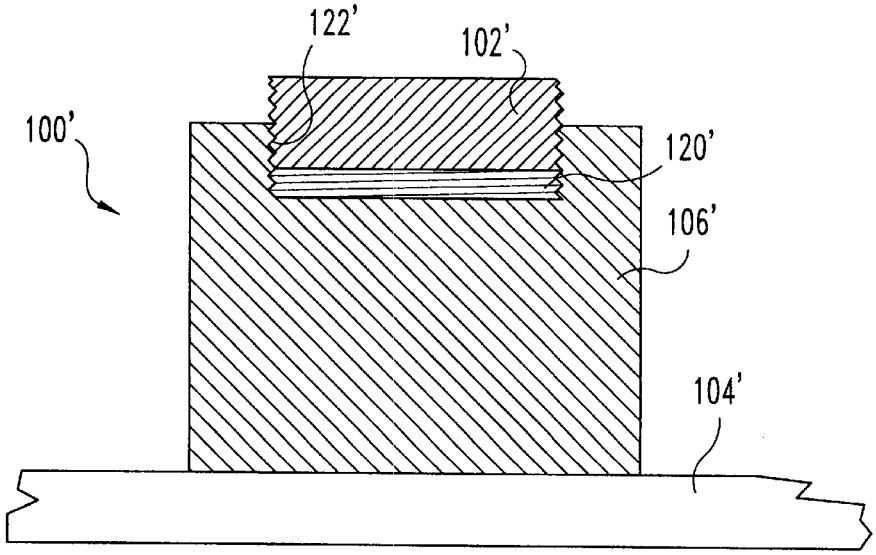
FIG. 1D is a cross-sectional side view of an externally threaded dielectric element screwed to an internally threaded alternate first embodiment attachment assembly of the present invention.

FIG. 1D illustrates one alternative embodiment of the present invention, a dielectric resonator system 100' wherein attachment assembly 106' is connected to housing 104' and includes an internally threaded recess 120' adapted to threadingly engage external threads 122' formed on dielectric element 102'.

Figure 2:
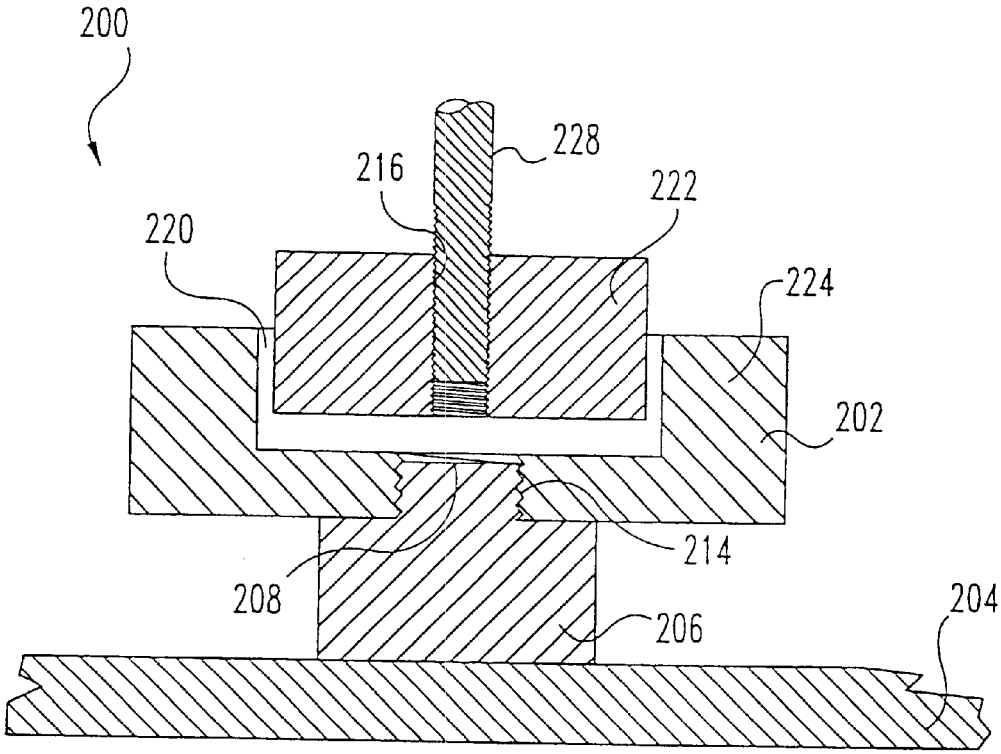
FIG. 2 is a cross-sectional view of a partially internally threaded dielectric element having an upper recess and secured to a second embodiment attachment assembly of the present invention, showing a tuning element positioned within the upper recess.

FIG. 2 illustrates another embodiment of the present invention, a dielectric resonator system 200 including a dielectric element 202 mounted to a housing 204 by an attachment assembly 206. In this embodiment of the present invention, the above-described dielectric resonator system 100 is further modified by the inclusion of a tuning plug 222. Dielectric element 202 is preferably a ceramic perovskite, but may be any convenient dielectric composition having desirable electrical and mechanical properties. Dielectric element 202 is preferably a ring formed having a threaded inner portion 208 adapted to threadedly engage a threads 214 formed on the (preferably at least 99.5% pure alumina) attachment assembly 206. The top portion 224 of dielectric ring 202 includes a cylindrical tuning recess 220 adapted to at least partially receive a tuning plug 222. Tuning plug 222 is mounted to a rod 228 that extends through a cavity 216 formed in tuning plug 222 and protrudes through an aperture (not shown) in housing 204. In the embodiment illustrated in FIG. 2, rod 228 is preferably made of alumina or other suitable material and is threadedly coupled to tuning plug 222, but may also be affixed by any known coupling means. The resonance of dielectric system 200 is fine-tuned as tuning plug 222 is advanced into or withdrawn from recess 220. The movement of tuning plug 222 is halted when the desired resonant frequency is attained.

Dielectric element 202 and attachment assembly 206 preferably have substantially the same coefficient of thermal expansion, and more preferably have coefficients of thermal expansion of about $5–10\times10^{-6}$/° C. Attachment assembly preferably has a loss tangent less than about $1\times10^{-4}$ and preferably has a thermal conductivity of at least about 25 W/m/K at 25° C.

Figure 3A:
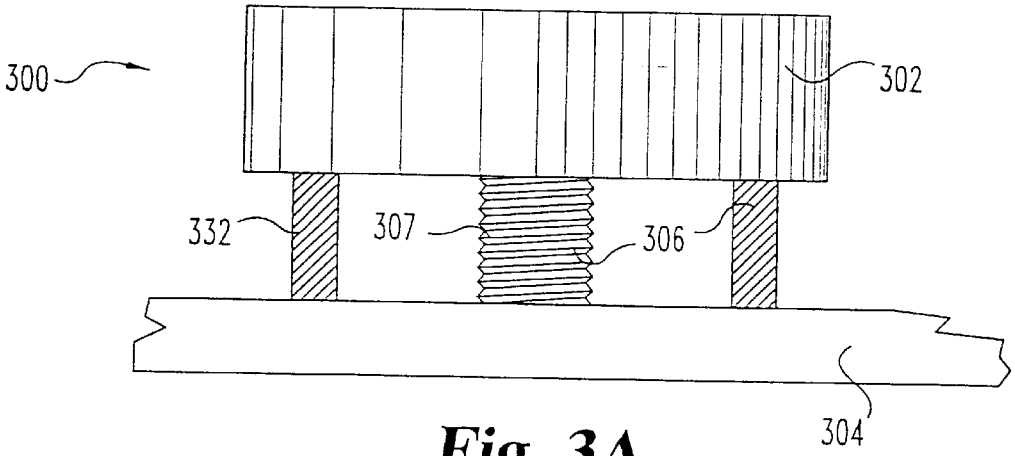
FIG. 3A is a side view of a dielectric element supported by a third embodiment attachment assembly of the present invention.
Figure 3B:
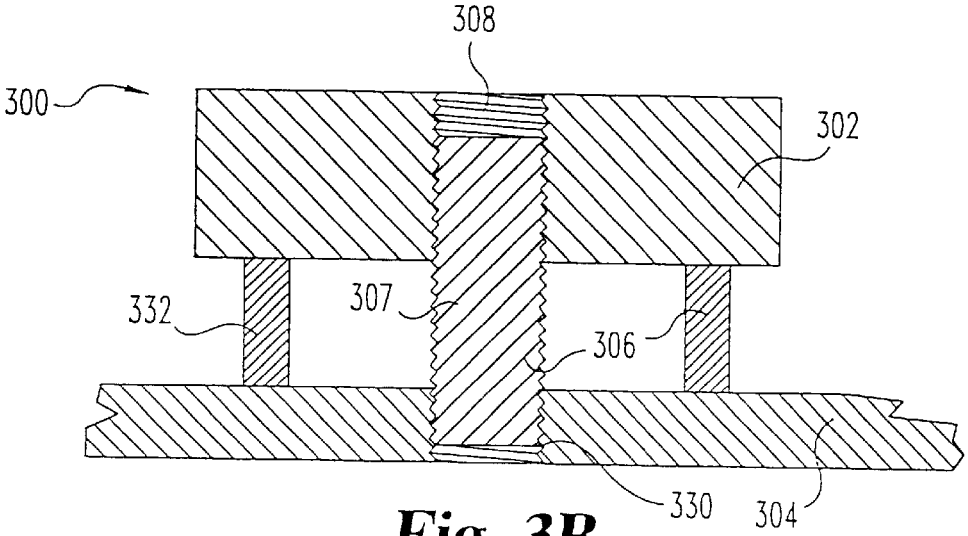
FIG. 3B is a cross-sectional side view of a dielectric element screwed to the third embodiment attachment assembly of FIG. 3A.

FIGS. 3A and 3B illustrate still another embodiment of the present invention, a dielectric resonator system 300 including a dielectric element 302 mounted to a casing 304 by an attachment assembly 306. In this embodiment of the present invention, dielectric element 302 is preferably a ring having a hollow, threaded cylindrical central recess 308 extending therethrough. Dielectric element 302 is preferably a ceramic perovskite material but may be any convenient dielectric material having desirable physical properties. Attachment assembly 306 is externally threaded and includes a screw member 307 adapted to threadedly engage threaded recess 308. Screw member 307 may therefore be rotatably advanced through dielectric element 302. Casing 304 features an aperture 330 also threaded to mate with screw 307. Attachment assembly 306 also includes an electrically insulating support cylinder 332 extending from casing 304 to dielectric ring 302, preventing it from moving. Cylinder 332 is preferably formed from alumina and may be affixed to housing 304 with adhesive, such as ceramic cement. Alternatively, one or more discrete support spacers (not shown) may be used to additionally support dielectric ring 302. The resonance of dielectric system 300 is tuned as screw member 307 is advanced into dielectric ring 302. The advancement of screw member 307 is halted when the desired resonant frequency is attained.

Dielectric element 302 and attachment assembly 306 preferably have substantially the same coefficient of thermal expansion, and more preferably have coefficients of thermal expansion of about $5–10\times10^{-6}/°$ C. Attachment assembly preferably has a loss tangent less than about $1\times10^{-4}$ and preferably has a thermal conductivity of at least about 25 W/m/K at 25° C.

Figure 4:
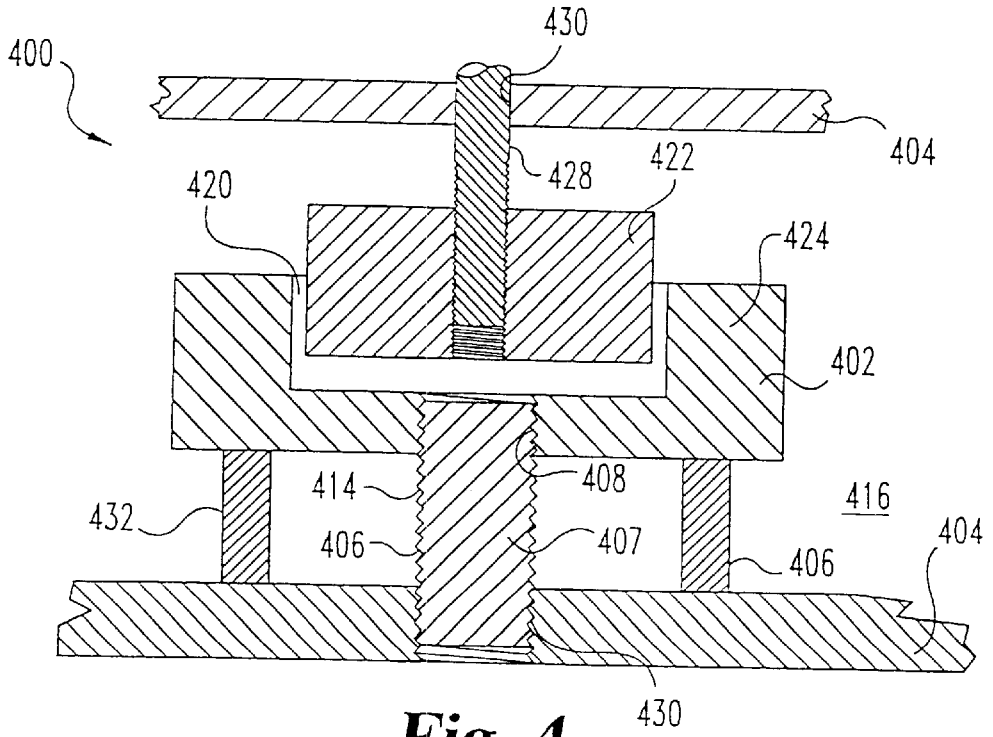
FIG. 4 is a cross-sectional view of a partially internally threaded dielectric element having an upper recess and secured to a fourth embodiment attachment assembly of the present invention, showing a tuning element positioned within the upper recess.

FIG. 4 illustrates yet another embodiment of the present invention, a dielectric resonator system 400 including a dielectric element 402 mounted to a housing 404 by an attachment assembly 406. In this embodiment of the present invention, the above-described dielectric resonator system 300 is further modified by the inclusion of a tuning plug 422. Dielectric element 402 is preferably formed from a ceramic perovskite material and is preferably a ring formed having a threaded inner portion 408 adapted to threadedly engage a threaded outer portion 414 of the (preferably at least 99.5% pure alumina) attachment assembly 406. Dielectric ring 402 includes a top portion 424 having a cylindrical tuning recess 420 adapted to at least partially receive tuning plug 422. Tuning plug 422 is mounted to a rod 428 that extends through a cavity 420 formed in tuning plug 422 and protrudes through an aperture 430 formed in housing 404. Attachment assembly 406 includes screw member 407 adapted to threadedly engage aperture 430 and dielectric ring 402. Attachment assembly 406 further includes at least one support member 432 extending between dielectric ring 402 and housing 404.

In the embodiment illustrated in FIG. 4, rod 428 is preferably made of alumina or other suitable material and is threadedly coupled to tuning plug 422, but may also be affixed by any known coupling means. The resonance of dielectric system 400 is therefore tuned by the placement of the screw 407 within dielectric ring 402 and is further fine-tuned as tuning plug 422 is advanced into tuning recess 420. The advancement of plug 422 is halted when the desired resonant frequency is attained.

Dielectric element 402 and attachment assembly 406 preferably have substantially the same coefficient of thermal expansion, and more preferably have coefficients of thermal expansion of about $5–10\times10^{-6}/°$ C. Attachment assembly preferably has a loss tangent less than about $1\times10^{-4}$ and preferably has a thermal conductivity of at least about 25 W/m/K at 25° C.

Figure 5A:
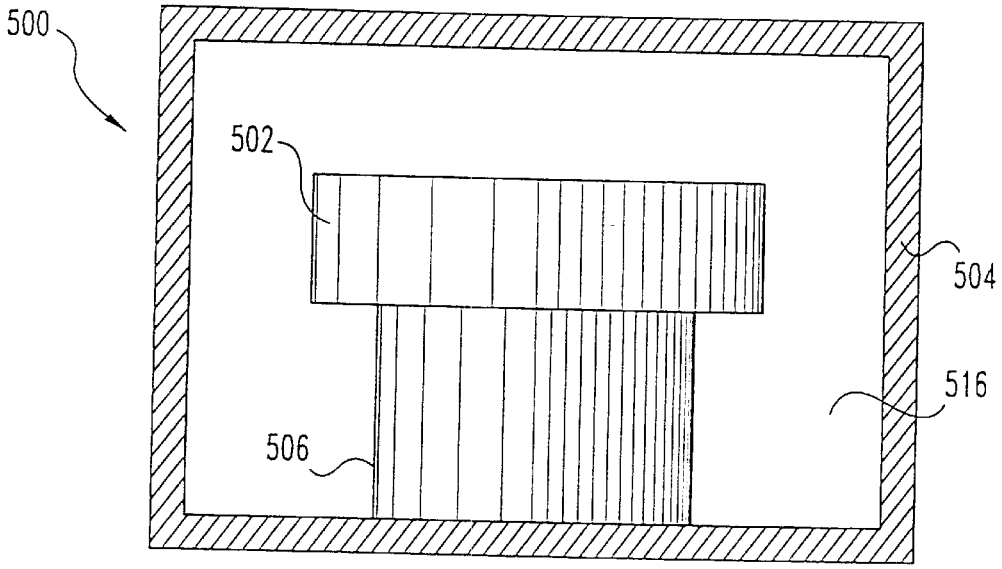
FIG. 5A is a partial cross-sectional side view of a dielectric element in a housing and supported by an attachment assembly of a fifth embodiment of the present invention.
Figure 5B:
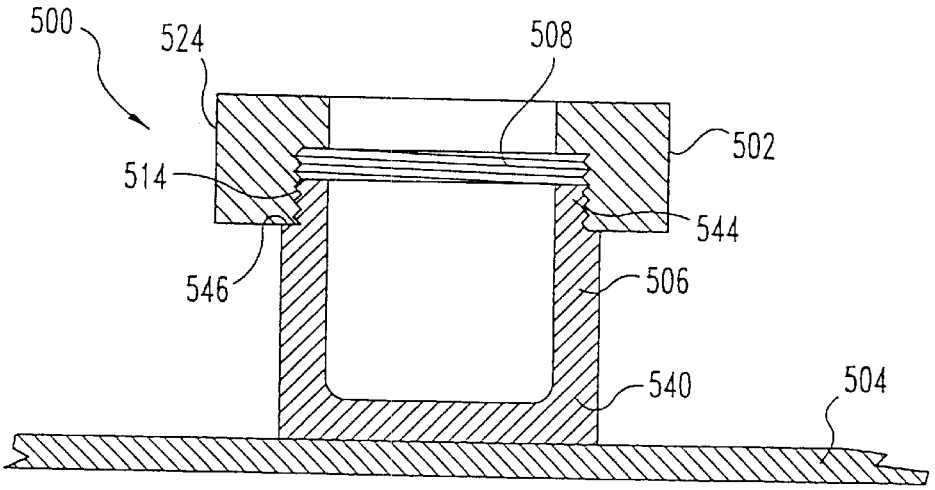
FIG. 5B is a cross-sectional side view of a partially internally threaded dielectric element screwed to attachment assembly of FIG. 5A.
Figure 5C:
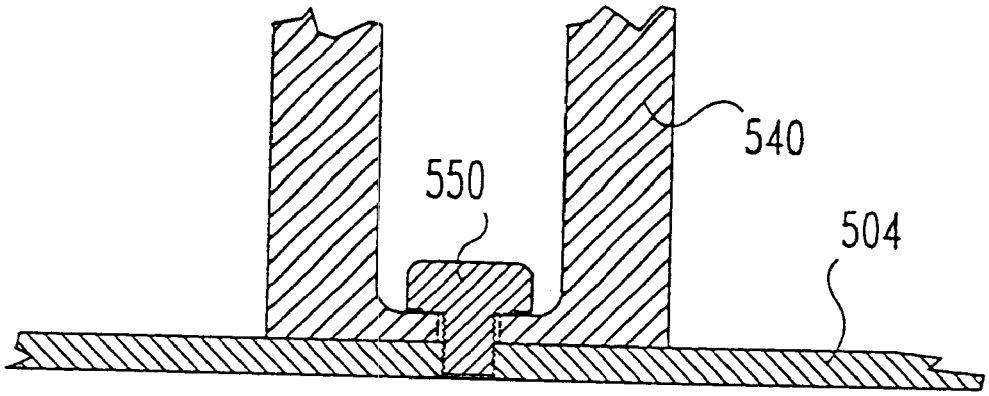
FIG. 5C is a cross-sectional side view of FIG. 5A showing attachment assembly connected to housing by a screw.

FIGS. 5A–5C illustrate still another embodiment of the present invention, a dielectric resonator 500 including a dielectric element 502 mounted to a housing 504 by an attachment assembly 506. In this embodiment, dielectric element 502 is preferably a disk formed of dielectric ceramic material (more preferably from E29, E36, or E45) having a threaded inner recess portion 508 adapted to threadedly engage a threaded outer portion 514 of the (preferably at least 99.5% pure alumina) attachment assembly 506. Dielectric disk 502 includes a top portion 524 that preferably is solid. Attachment assembly 506 is preferably an alumina cylinder and includes a bottom portion 540 and a threaded top portion 544 defining a shoulder 546 therebetween. Dielectric disk 502 is adapted to threadedly engage threaded top portion 544 of attachment assembly 506 and rest on or above shoulder 546. Attachment assembly 506 is preferably hollow with a substantially solid bottom portion 540. Attachment assembly 506 may be coupled to housing 504 by adhesives (not shown), one or more fasteners 550 (see FIG. 5C) penetrating bottom portion 540 and housing 504, by mating bottom portion 540 and housing 504 either threadedly or by an interference fitting, or by any convenient coupling means. The resonance of dielectric system 500 is at least partially tuned by the placement of dielectric element 502 within cavity 516.

Dielectric element 502 and attachment assembly 506 preferably have substantially the same coefficient of thermal expansion, and more preferably have coefficients of thermal expansion of about $5\times10^{-6}/°$ C. Attachment assembly preferably has a loss tangent less than about $1\times10^{-4}$ and preferably has a thermal conductivity of at least about 25 W/m/K at 25° C.

Figure 6A:
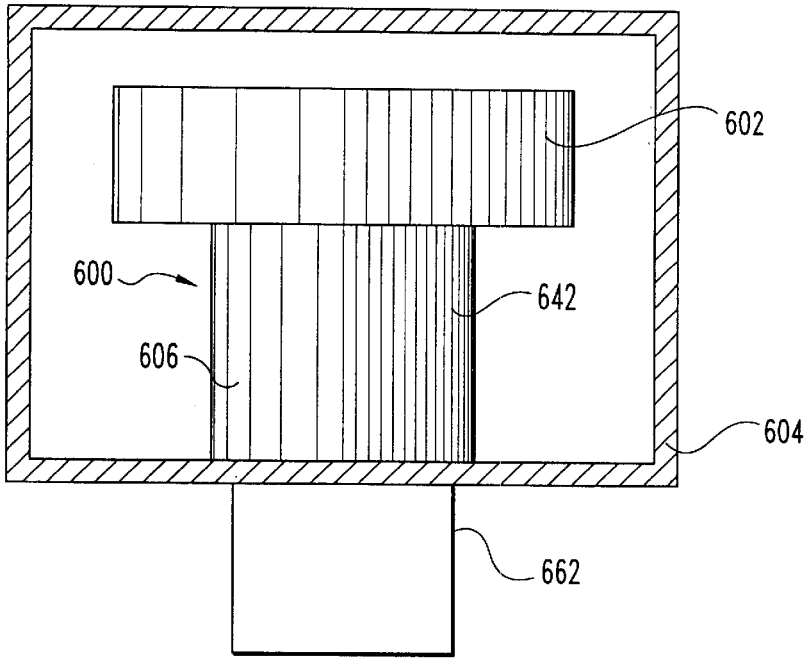
FIG. 6A is a partial cross-sectional view of a dielectric element in a housing and supported by a sixth embodiment of the present invention.
Figure 6B:
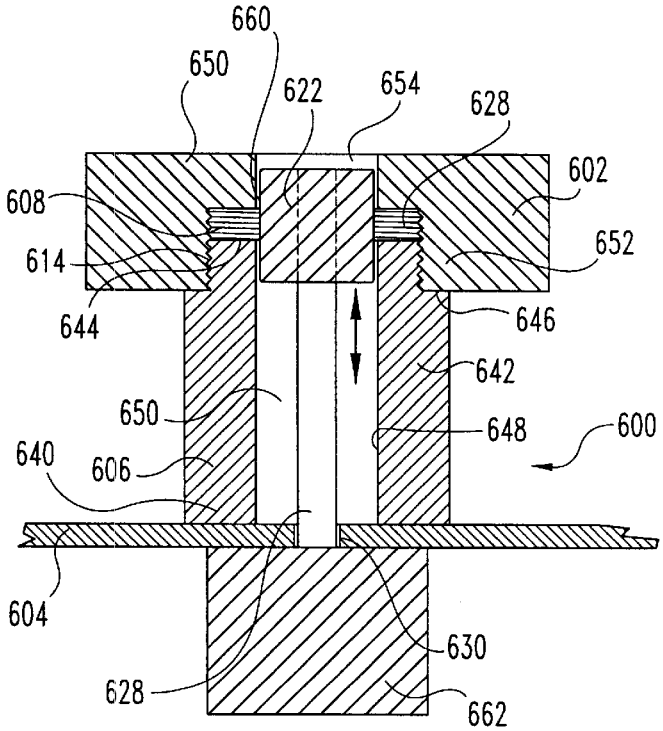
FIG. 6B is a cross-sectional side view of FIG. 6A, showing a tuning element positioned within the inner diameter of dielectric element.

FIGS. 6A and B illustrate yet another embodiment of the present invention, a dielectric resonator system 600 including a dielectric element 602 mounted within a housing 604 by an attachment assembly 606. Dielectric element is preferably formed from a ceramic perovskite material, although it may be formed from any convenient dielectric material having desirable electrical and mechanical properties. Attachment assembly 606 is preferably formed of at least about 99.5% pure alumina and preferably has the form of a hollow support column attached. Attachment assembly 606 may be attached to housing 604 by fasteners (not shown) such as bolts or screws, by adhesives (not shown) such as alumina cement, or may be externally threaded and matably attached to an internally threaded aperture (as are the attachment assemblies of FIGS. 3A, 3B and 4) formed in housing 604. Attachment assembly 606 has a bottom portion 640, a central portion 642, and a top portion 644. Top portion 644 includes external threads 614 and has a smaller outer radius than does central portion 642. The intersection of top portion 644 and central portion 642 defines a shoulder 646. Attachment assembly 606 has a hollow, axially centered cylindrical core 648 of substantially constant radius.

Dielectric element 602 illustrated in FIGS. 6A and B has the shape of a ring, although it can have any desired shape. Dielectric ring 602 has a top portion 650 and a bottom portion 652. Bottom portion 652 of dielectric ring 602 features a threaded circular recess 608 adapted to threadedly engage threads 614 of top portion 644 of attachment assmebly 606.

Top portion 650 of dielectric ring 602 further includes an inner core 654 with a radius substantially equal to that of cylindrical core 648 of attachment assembly 606. When dielectric ring 602 is threadedly engaged with attachment assembly 606 and seated on or above shoulder 646, an extended axially centered cylindrical core 660 is defined. A substantially cylindrical dielectric tuning plug 622 adapted to slide within the extended axially centered cylindrical core 660 is used to fine-tune the dielectric resonant frequency of the system 600. Dielectric plug 622 is mounted on a rod 628 that extends from plug 622 axially through the cylindrical core 660 and protrudes through aperture 630 in housing 604. In one embodiment the protruding end of rod 628 is attached to a control knob 662, which may be rotated to change the axial position of plug 622 within core 660. Alternatively, element 662 may comprise an electromechanical actuator, such as a linear actuator.

Dielectric element 602 and attachment assembly 606 preferably have substantially the same coefficient of thermal expansion, and more preferably have coefficients of thermal expansion of about $5\times10^{-6}$/° C. Attachment assembly preferably has a loss tangent less than about $1\times10^{-4}$ and preferably has a thermal conductivity of at least about 25 W/m/K at 25° C.

Figure 6C:
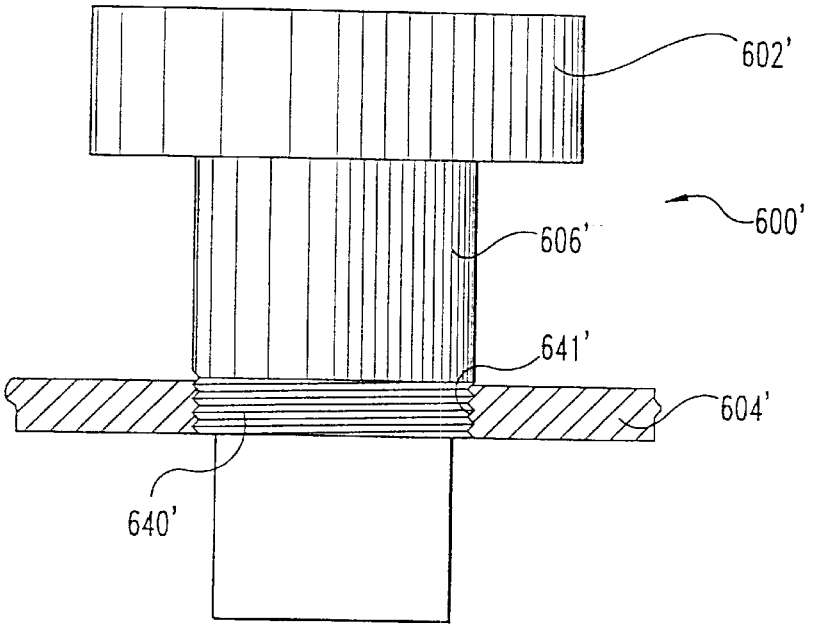
FIG. 6C is a cross-sectional side view of a first variation of FIG. 6A.

Variations on this embodiment include a dielectric resonator 600' including an attachment assembly 606' for connecting dielectric element 602' and having a threaded bottom portion 640' which is adapted to engage a threaded entry aperture 641' formed in housing 604', as illustrated in FIG. 6C. The ceramic attachment assembly 606' therefore comprises a support structure having a threaded bottom portion 641' directly threadedly attachable to housing 604'.

Figure 6D:
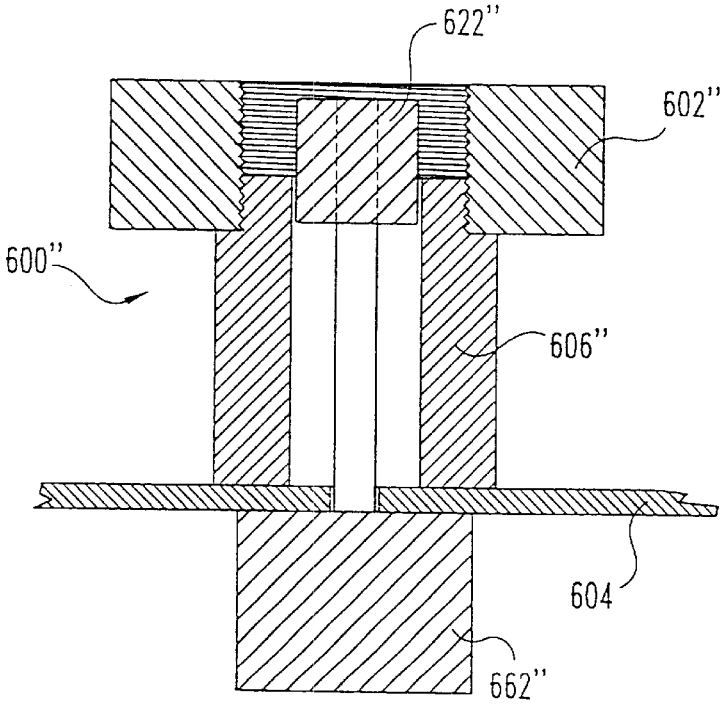
FIG. 6D is a cross-sectional view of a second variation of FIG. 6C.

Another variation of the sixth embodiment dielectric resonator system 600", shown in FIG. 6D, includes a completely internally threaded dielectric ring 602" screwed to the top portion of externally threaded ceramic support member 606". Dielectric plug 622" is still provided to be variably positioned near or within dielectric ring 602". The positioning of dielectric plug 622" is controlled by knob 662".

Yet other variations of the third embodiment include the use of different geometries for the tuning plug, such as cubic or spherical (not shown). Still other variations of the third embodiment contemplate the use of various compositions for the tuning plug, such as glass, ceramic, plastic, or composite (not shown). Still another variation contemplates the use of a solenoid, linear actuator, or the like to automatically actuate the tuning plug into position (not shown).

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A dielectric resonator system comprising:

a housing defining a cavity;

an externally threaded ceramic attachment assembly mounted within the housing; and an internally threaded dielectric element threadedly coupled to the attachment assembly;

wherein the attachment assembly is at least about 99.5% pure;

wherein the dielectric element and the attachment assembly have substantially the same coefficent of thermal expansion; and wherein the attachment assembly has a loss tangent less than about 0.0002.

2. The system of claim 1 wherein the dielectric element comprises an internally threaded ceramic ring.

3. The system of claim 2 wherein the dielectric ring is a ceramic perovskite.

4. The system of claim 1 wherein attachment assembly has a thermal conductivity of at least about 25 W/M/K at 25° C.

5. The system of claim 1 wherein the attachment assembly includes a substantially cylindrical alumina support member.

6. The system of claim 1 wherein the attachment assembly includes an alumina support structure having an externally threaded top portion and a bottom portion defining a shoulder therebetween and wherein the dielectric element is threadedly mated to the top portion and rests on the shoulder.

7. The system of claim 1 further comprising:

a threaded entry aperture formed in the housing;

wherein the externally threaded ceramic attachment assembly threadedly engages the entry aperture.

8. The system of claim 1 wherein the attachment assembly comprises:

a hollow alumina support structure having an externally threaded top portion and a central portion defining a shoulder therebetween;

a bottom portion;

a substantially cylindrical core formed in the hollow support structure;

wherein the dielectric element is a ring threadedly coupled to the top portion of the alumina support structure; and a dielectric tuning plug adapted to slidably move within the cylindrical core and the ring.

9. The system of claim 8 further comprising a rod coupled to the dielectric tuning plug and protruding through the housing.

10. The system of claim 1 wherein the attachment assembly comprises:

an alumina support structure having an at least partially externally threaded top portion, a central portion, and a bottom portion;

a threaded entry aperture formed in the housing; and a dielectric tuning plug adapted to slidably move within the dielectric element;

wherein the dielectric element is an at least partially internally threaded ring having a recess formed therein and threadedly coupled to the top portion of the alumina support structure.

11. The system of claim 10 wherein the bottom portion is externally threaded and wherein the bottom portion threadedly engages the threaded entry aperture.

12. The system of claim 1 wherein the attachment assembly comprises:

a threaded dielectric tuning screw threadedly coupled to the dielectric element and to the housing; and a support cylinder extending from the housing to the dielectric element.

13. The system of claim 12 wherein the dielectric element includes a recess and further comprising:

a tuning plug;

a rod connected to the tuning plug and extending through the housing; and wherein the tuning plug slidably engages the recess.

14. The system of claim 1 wherein the attachment assembly includes:

a substantially cylindrical hollow alumina support structure member with a thermal conductivity of at least about 25 W/M/K at 25° C. and having an externally threaded top portion and a central portion defining a shoulder therebetween;

a bottom portion coupled to the housing; and a dielectric tuning plug;

wherein the dielectric element includes:

a partially hollow internally threaded ceramic disk; and a recess;

wherein the dielectric element is a ring threadedly coupled to the top portion of the alumina support structure member;

wherein the tuning plug is slidingly engaged within the recess.

15. The system of claim 1 wherein the attachment assembly includes:

a substantially cylindrical hollow externally threaded alumina support structure member with a thermal conductivity of at least about 25 W/M/K at 25° C.;

a threaded entry aperture formed in the housing; and a dielectric tuning plug;

wherein the dielectric element is an internally threaded ring;

wherein the dielectric element has an upper recess;

wherein the dielectric element is threadedly coupled to the top portion of the alumina support structure member; and wherein the dielectric tuning plug is adapted to slidably move within the internally threaded ring.

16. The system of claim 1 wherein the dielectric element includes a tuning recess and further comprising:

a tuning plug;

a rod connected to the tuning plug and extending through the housing; and wherein the tuning plug slidably engages the tuning recess.

17. The system of claim 16 wherein the placement of the dielectric element within the cavity tunes the resonant frequency of the system.

18. The system of claim 16 wherein the placement of the dielectric element within the cavity tunes the resonant frequency of the system and wherein the placement of the tuning plug in the tuning recess fine-tunes the system.

19. A dielectric resonator system comprising:

a metallic casing;

a threaded dielectric element housed within the metallic casing; and a threaded alumina attachment assembly connecting the metallic casing and the dielectric element;

wherein the alumina attachment assembly is at least 99.5% pure.

20. The system of claim 19 wherein the dielectric element is internally threaded and wherein the alumina attachment assembly further comprises an externally threaded alumina member threadedly coupled to the dielectric element.

21. The system of claim 19 wherein the dielectric element is externally threaded and wherein the alumina attachment assembly further comprises an internally threaded alumina member threadedly coupled to the dielectric element.

22. A dielectric resonator, comprising:

a housing having an entry aperture;

a ceramic support member having a threaded top end and a bottom end defining a shoulder therebetween;

a dielectric disk resting on the shoulder; and wherein the ceramic support member is at least about 99.5% pure;

wherein the ceramic support member has a thermal conductivity of at least about 25 W/M/K at 25° C.;

wherein the ceramic support member has a coefficient of thermal expansion substantially equal to that of the dielectric disk; and wherein the bottom end is coupled to the housing.

23. A dielectric resonator comprising:

a casing having a threaded aperture;

a dielectric element having a threaded internal diameter; and at least one threaded ceramic support member adapted to extend from the casing to the dielectric element;

wherein the at least one threaded ceramic support member is at least about 99.5% pure; and wherein the at least one threaded ceramic support member has a coefficient of thermal conductivity of at least about 25 W/M/K at 25° C.

24. The dielectric resonator of claim 23 wherein the dielectric element has a top portion and a bottom portion, the top portion having an inner cavity, and further comprising:

a substantially cylindrical dielectric tuning plug slidably adapted to enter the cavity; and a support rod affixed to the dielectric tuning plug and protruding through the casing.

25. A method of tuning a dielectric resonator comprising the steps of:

a) providing a dielectric element having a tuning cavity formed therein;

b) providing a resonating cavity defined by a housing;

c) providing an attachment assembly formed of at least 99.5% pure alumina and connecting the dielectric element to the housing;

d) providing a tuning dielectric; and e) moving the tuning dielectric within the tuning cavity.

26. The method of claim 25 further comprising the steps of:

providing threads on the surface of the attachment assembly;

providing a threaded aperture in the housing;

threadedly engaging the attachment assembly and the housing; and rotating the attachment assembly to move the tuning dielectric within the housing.

27. The method of claim 25 further comprising the steps of:

providing the attachment assembly as a substantially hollow attachment assembly;

providing the tuning dielectric as a tuning plug adapted to slidingly move within the substantially hollow attachment assembly; and moving the tuning plug within the attachment assembly.

* * * * *